US006707987B2

(12) United States Patent
Zimmer

(10) Patent No.: US 6,707,987 B2
(45) Date of Patent: Mar. 16, 2004

(54) ELECTRIC LIQUEFIED PETROLEUM GAS VAPORIZER

(75) Inventor: George M. Zimmer, Kent, WA (US)

(73) Assignee: Algas-SDI International LLC, Seattle, WA (US)

( * ) Notice: Subject to any disclaimer, the term of this patent is extended or adjusted under 35 U.S.C. 154(b) by 31 days.

(21) Appl. No.: 09/878,838

(22) Filed: Jun. 8, 2001

(65) Prior Publication Data

US 2002/0186965 A1 Dec. 12, 2002

(51) Int. Cl.[7] ..... F22B 29/06; F23D 11/44

(52) U.S. Cl. ..... 392/397; 431/208

(58) Field of Search ..... 392/386, 387, 392/394, 396, 397, 479, 480, 481, 482, 483, 484, 485–490; 165/80.2, 80.5; 431/208, 209, 210; 239/135, 136, 139; 261/142, DIG. 65

(56) References Cited

U.S. PATENT DOCUMENTS

| | | | | |
|---|---|---|---|---|
| 3,250,723 A | * | 5/1966 | Fortney | 392/397 |
| 3,475,916 A | | 11/1969 | Smith | 62/52 |
| 3,676,642 A | | 7/1972 | Rosen et al. | 219/301 |
| 4,334,141 A | * | 6/1982 | Roller et al. | 219/505 |
| 4,343,988 A | * | 8/1982 | Roller et al. | 165/165 |
| 4,371,777 A | * | 2/1983 | Roller et al. | 219/505 |

FOREIGN PATENT DOCUMENTS

| | | |
|---|---|---|
| DE | 764 226 | 6/1953 |
| DE | 12 33 889 | 2/1967 |
| EP | 1 139 007 | 10/2001 |

* cited by examiner

*Primary Examiner*—Sang Paik
(74) *Attorney, Agent, or Firm*—Harold H. Bennett, II; Seed IP Law Group PLLC

(57) ABSTRACT

A vaporizer having a pair of heat exchanger blocks each with a vaporization tube formed therein. The heat exchanger blocks are in face-to-face arrangement and the vaporizer tubes are coupled together in series. A plurality of positive temperature coefficient (PTC) heating elements are clamped in position between the heat exchanger blocks to provide the heat for vaporization of the liquefied gas. A capacity control valve controls the flow of liquefied gas into the vaporizer tubes.

38 Claims, 8 Drawing Sheets

ELECTRIC LIQUEFIED PETROLEUM GAS VAPORIZER

TECHNICAL FIELD

This invention relates to a vaporizer for vaporizing liquefied gases such as liquefied petroleum gas, and in particular, to heat exchangers used in liquefied gas vaporizers.

BACKGROUND OF THE INVENTION

Vaporizers for the controlled vaporization of liquefied gases are generally known. One electrically heated liquefied petroleum gas (LPG) vaporizer is disclosed in U.S. Pat. No. 4,255,646. Another liquefied gas vapor unit is disclosed in U.S. Pat. No. 4,645,904. Typically, the vaporizer includes a hollow, pressure vessel having a liquefied gas inlet near a lower end and a gas vapor outlet near a closed upper end remote from the liquefied gas inlet. A heating core is typically disposed within the pressure vessel, usually positioned close to the lower end. A plurality of resistive electric heating element may be embedded within the heating core.

Such vaporizers using electric heating elements often require the use of a temperature sensor coupled with a time proportional controller for applying power to the heating elements with a periodic on/off duty cycle determined by the deviation of the core temperature from a predetermined set point. An increase of the core temperature above the set point proportionately reduces the on time of the duty cycle, while a decrease of the core temperature below the set point proportionately increases the on time of the duty cycle. Control circuitry including switches are required.

The vaporizer may also have liquefied gas sensing means communicating with the interior of the pressure vessel near its upper end, below the gas vapor outlet. The liquefied gas sensing means is typically an overflow sensor or "float switch" for sensing the level of liquefied gas in the pressure vessel and controlling a valve that opens and closes to stop the flow of liquefied gas into the pressure vessel. Accordingly, the valve is controlled to open the pressurized flow of liquefied gas into the pressure vessel and to shut off the flow before the liquefied gas fills the gas vapor head space and liquefied gas floods through the outlet of the vaporizer.

A problem with such known vaporizers is the need to control the on/off duty cycle of the electric heater elements to prevent overheating. The circuitry required creates safety concerns, and in addition, maintenance and reliability concerns are created. Further, the circuitry increases the cost of manufacturing the vaporizer.

SUMMARY OF THE INVENTION

The present invention resides in a vaporizer for vaporizing a fluid with a heat exchanger having a mass of thermally conductive material and a tube embedded therein to transfer heat from the thermally conductive material to the contents of the tube, and a plurality of positive temperature coefficient heater elements thermally coupled to heat to the thermally conductive material. The tube has an inlet portion to receive the fluid to be vaporized and an outlet portion to discharge the vaporized fluid.

In one embodiment of the vaporizer, the heat exchanger has a block of thermally conductive material with a tube embedded therein and with a planar surface portion. The heater elements are each flat with a substantially planar surface arranged in coplanar parallel arrangement with the planar surface portion of the block. The block further includes an end surface, and the inlet and outlet portions of the tube project from the end surface of the block.

In this embodiment, the heater elements are electrically coupled in parallel and each has a cure temperature greater than the saturation temperature of the fluid to be vaporized. The heater elements are connectable directly to an electrical power source without regulation by the vaporizer of the power supplied by the power source. The tube extends within the block along a curved path.

In one embodiment, the vaporizer includes a first heat exchanger having a first block of thermally conductive material with a first tube embedded therein to transfer heat from the thermally conductive material of the first block to the contents of the first tube, with the first block having a surface portion. The first tube has an inlet portion to receive the fluid to be vaporized and an outlet portion to discharge the vaporized fluid. The vaporizer further includes a second heat exchanger having a second block of thermally conductive material with a second tube embedded therein to transfer heat from the thermally conductive material of the second block to the contents of the second tube, with the second block having a surface portion. The second tube has an inlet portion to receive the fluid to be vaporized and an outlet portion to discharge the vaporized fluid. The first and second blocks are arranged with the surface portions thereof facing each other, and the outlet portion of the first tube connected to the inlet portion of the second tube. This embodiment further includes a plurality of positive temperature coefficient heater elements. Each heater element is formed with first and second opposed surfaces. The heater elements are positioned between the first and second blocks with the first surfaces of the heater elements in thermal contact with the surface portion of the first block and with the second surfaces of the heater elements in thermal contact with the surface portion of the second block.

The inlet and outlet portions of the first and second tubes project from the respective first and second blocks. The vaporizer further includes at least one member holding the first and second blocks tightly together with the heater elements positioned therebetween clamped tightly between the surface portions of the first and second blocks.

In this embodiment, the heater elements may be arranged in a single row alignment. The heater elements are elongated and each is oriented with a longitudinal axis arranged transverse to a direction of the row, and every other one of the heater elements in the row is longitudinally offset from the adjacent heater elements.

The first block further includes an end surface, and the inlet and outlet portions of the first tube project from the end surface of the first block. The second block further includes an end surface, and the inlet and outlet portions of the second tube project from the end surface of the second block. The end surfaces of the first and second blocks are arranged one adjacent to the other, and the outlet portion of the first tube is connected to the inlet portion of the second tube at a location adjacent to the adjacent end surfaces.

In some embodiments, the vaporizer includes a chamber with the thermally conductive material being a fluid contained within the chamber. The heater elements are immersed in the thermally conductive fluid.

In some embodiments the tube includes a coiled portion embedded in the thermally conductive material. The thermally conductive material may have a cylindrical shape with a longitudinal axis and the coiled portion of the tube may be arranged about the longitudinal axis. The heater elements may each include a rod shaped portion embedded in the thermally conductive material.

A method is also disclosed for forming a low-profile vaporizer with the foregoing constructions.

Other features and advantages of the invention will become apparent from the following detailed description, taken in conjunction with the accompanying drawings.

DETAILED DESCRIPTION OF THE INVENTION

Figure 1:
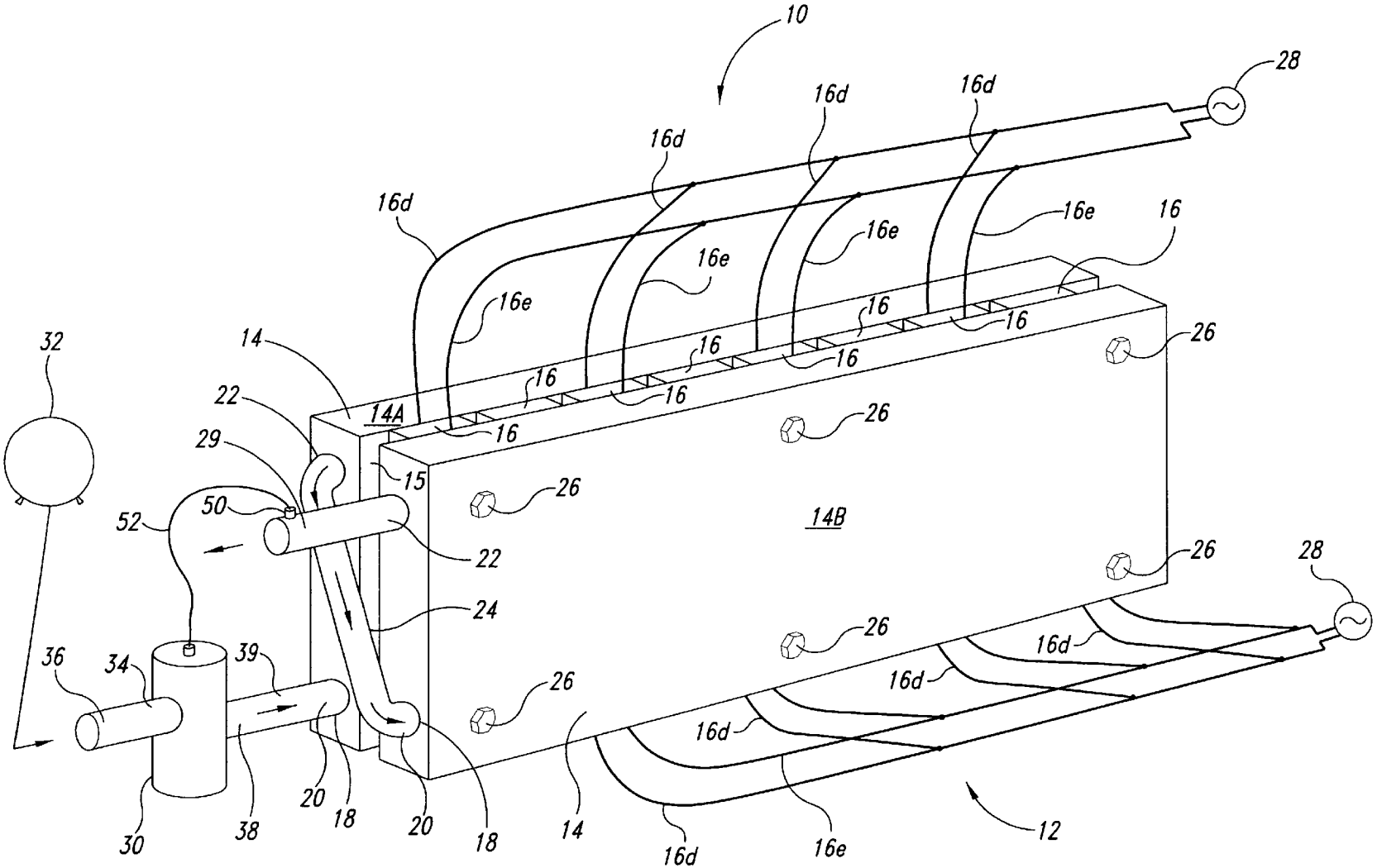
FIG. 1 is an isometric view of a liquefied gas vaporizer embodying the present invention having a heat exchanger comprised of two stacked heat exchanger blocks and a capacity control valve.

As shown in the drawings for purposes of illustration, the present invention is embodied in a liquefied gas vaporizer 10. The vaporizer 10 is shown in FIG. 1 as including a heat exchanger 12 comprised of two heat exchanger blocks 14 mounted face-to-face with eight positive temperature coefficient (PTC) heating elements 16 sandwiched between the heat exchanger blocks. In practice, ten PTC heating elements are used. One of the heat exchanger blocks is designated the first heat exchanger block and identified by reference numeral 14A, and the other of the heat exchanger blocks is designated the second heat exchanger block and identified by reference numeral 14B.

Figure 3:
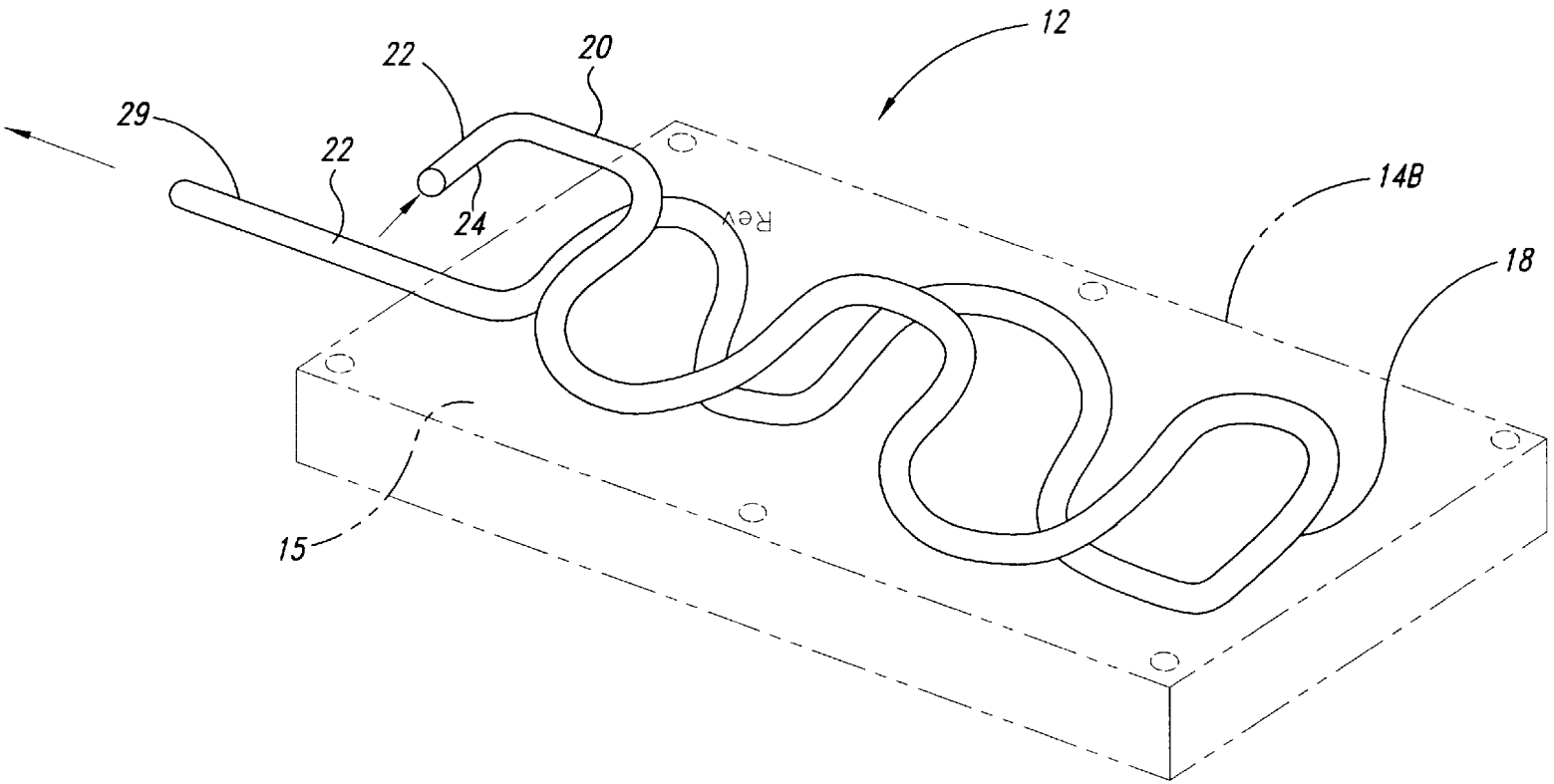
FIG. 3 is an isometric view of a vaporization tube used in each of the heat exchanger blocks of the vaporizer of FIG. 1.
Figure 6:
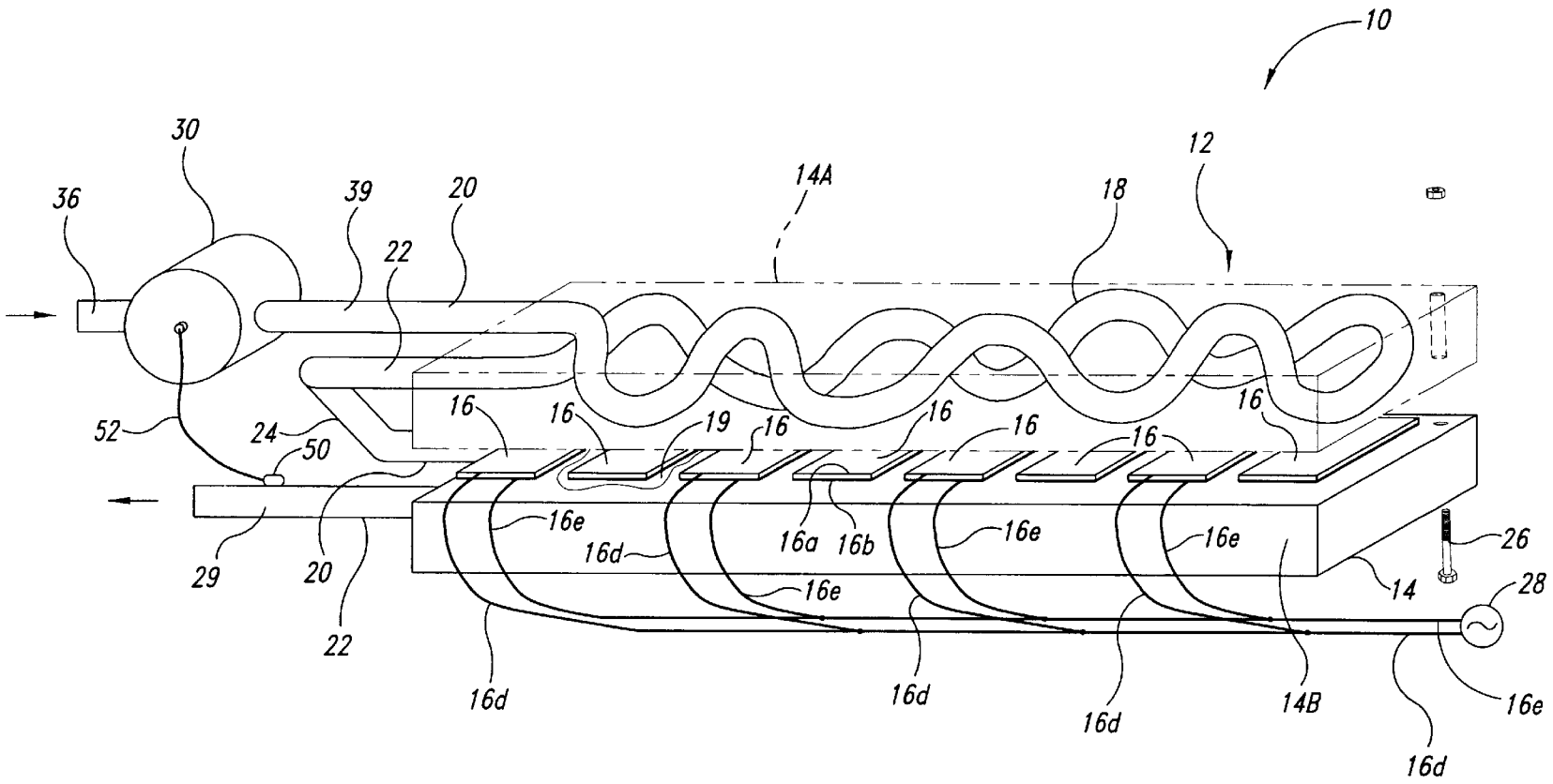
FIG. 6 is an isometric view of the vaporizer of FIG. 1 shown partially assembled with one to the heat exchanger blocks show in phantom line to better illustrate the vaporization tube encased therein.

Each of the heat exchanger blocks 14 is formed of a rectangular casting of a thermally conductive material, such as aluminum, with an integral vaporization tube 18 encased therein, as best shown in FIGS. 3 and 6. Each of the vaporization tubes 18 has an inlet 20 and an outlet 22. The vaporization tubes 18 of the heat exchanger blocks 14 are coupled together in series by a coupler tube 24 connecting the outlet 22 of the vaporization tube 18 of the first heat exchanger block 14A and the inlet 20 of the vaporization tube 18 of the second heat exchanger block 14B.

The heat exchanger blocks 14 are secured tightly together in face-to-face relation with the heating elements 16 sandwiched between them by a plurality of bolts 26, or alternatively other fasteners or clamps. An alternating current electrical power supply 28, operating at 110 to 240 volts, supplies electrical power to the heating elements 16. A capacity control valve 30 is coupled to the inlet 20 of the vaporization tube 18 of the first heat exchanger block 14A and controls the flow of liquefied gas from a liquefied gas source 32, such as a liquefied petroleum gas storage tank, to the heat exchanger 12. The vaporized gas exits through the outlet 22 of the vaporization tube 18 of the second heat exchanger block 14B and is supplied to a gas vapor outlet tube 29.

Figure 4A:
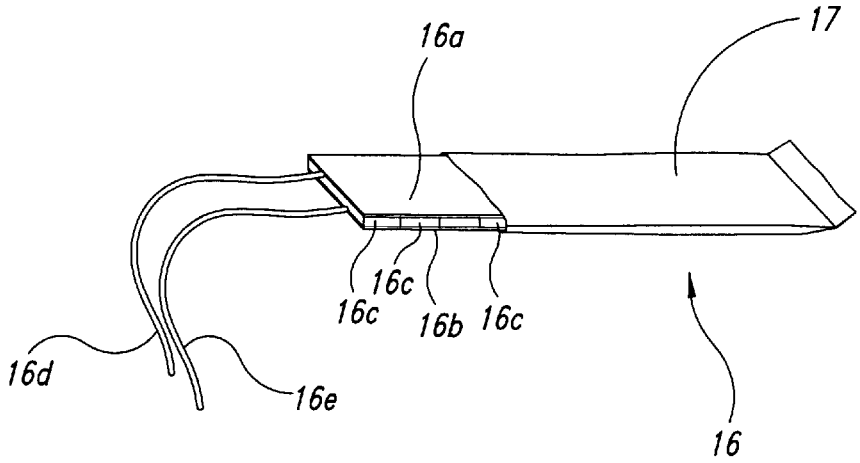
FIG. 4A is an isometric view of a positive temperature coefficient (PTC) heating element used to supply heat to the heat exchanger blocks of the vaporizer of FIG. 1.
Figure 4B:
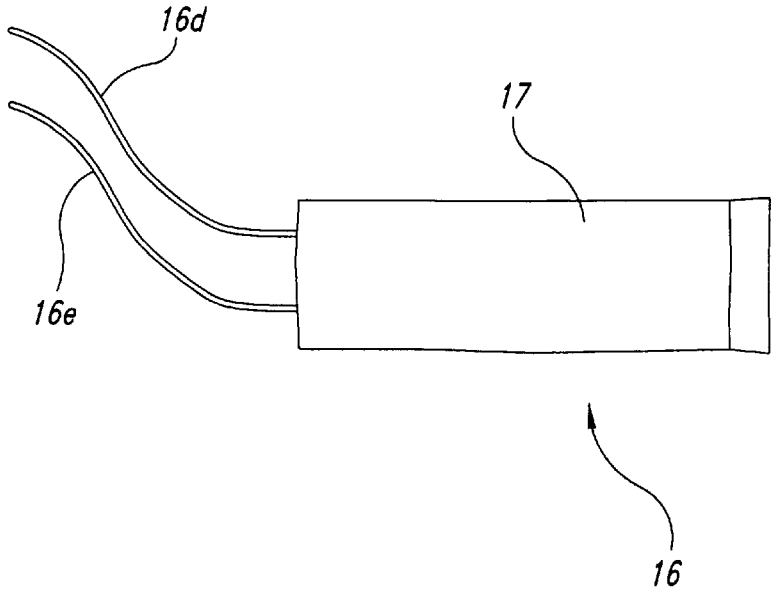
FIG. 4B is a front view of the heating element shown in FIG. 4A.

One of the PTC heating elements 16 used in the vaporizer 10 is shown by itself in FIGS. 4A and 4B. Such PTC heating elements are well known and include a pair of spaced-apart planar conductive plates 16*a* and 16*b* with a plurality of "stone" elements 16*c* positioned between the conductive plates. The PTC heating elements 16 have a flat, low side profile. An electrical lead 16*d* is attached to the end of one plate and an electrical lead 16*e* is attached to the end of the other plate to supply a voltage across the stones between the conductive plates. The stones 16*c* are arranged in a row between the conductive plates 16*a* and 16*b* with each stone having one face in electrical contact with one conductive plate and an opposite face in electrical contact with the other conductive plate. In the embodiment of the invention described, the PTC heating element is the EB style, using 5 stones sold by Dekko Enterprise of North Webster, Ind.

The stones 16*c* are composed of a thermally sensitive semiconductor resistor material that generates heat in response to a voltage applied across it by the conductive plates 16*a* and 16*b*, and have the characteristic of producing substantially the same heat output regardless of the voltage applied across it. As such, the PTC heating elements 16 produce a very constant heat output independent of the voltage used for the electrical power supply 28. This avoids having to carefully and accurately regulate the power source for the PTC heating elements 16 as is required in conventional electrical heater vaporizers so as to produce the desired heat. This produces a simpler and less expensive vaporizer. It also reduces the need and expenses incurred with conventional vaporizers requiring highly regulated power when adapting them for use in other countries that have very different power supply systems. The PTC heating elements 16 allow wide use without regard for the power supply system providing the electrical power for the heating elements. For example, a sample of the EB style, 5 stone PTC heating elements being used produces a surface temperature ranging from 103 to 117 degrees Centigrade when the voltage ranges from 120 volts to 230 volts, respectively.

Other advantages are realized by using the PTC heating elements 16. As noted, the stones 16*c* are arranged in a row between the conductive plates 16*a* and 16*b* so that if one stone fails, the other stones between the conductive plates continue to operate and produce heat, thus making the heating element resistant to total failures. In this regard, as shown in FIG. 1, the leads 16*d* of the heating elements 16 are connected together, and the leads 16*e* of the heating elements are connected together, such that the heating elements are connected in parallel to the electrical power supply 28. With this arrangement, should one of the heating elements 16 fail completely, the other heating elements will continue to have power supplied and to operate. A large enough number of heating elements 16 are used such that should some of the stones fail in several of the heating elements, or even several of the heating elements completely fail, the other heating elements will still provide enough heat to accomplish the desired vaporization of the liquefied gas supplied to the heat exchanger 12.

Another advantage results from the fact that the PTC heating elements 16 are self-regulating in that they have a cure temperature at which they operate and they will reduce the heat they generate if the temperature of the environment in which they are operating starts to go above their cure temperature. Thus, even though the maximum heat production of the number of PTC heating elements 16 used in the heat exchanger 12 may be more than needed, there is no need to use control circuitry to regulate the supply of power using a varying duty cycling or other control technique for temperature control purposes. The electrical power supplied by the electrical power supply 28 is simply connected directly to the PTC heating elements 16 without fear of producing a dangerous overheated situation where the temperature increases without control. This eliminates the need for expensive heating element temperature control circuitry as required for conventional resistive heating elements and eliminates the fear of overheating. By selecting PTC heating elements with a cure temperature that is just above the saturation temperature of the liquefied gas for which the vaporizer 10 is designed to vaporize, the heat exchanger 12 tends to operate at the selected temperature at all times without a need for power regulation to control the heat generated. As such, there is also no need for a high limit safety circuit as a fail-safe as required in a conventional vaporizer to cut off power to the heating elements should even the heating element temperature control circuitry fail to avoid overheating.

Using the PTC heating elements 16 ensures a self-regulated temperature that, when properly selected, cannot exceed the auto-ignition temperature of gas vapor being produced by the vaporizer 10. The self-regulated temperature is supplied constantly without power cycling that might otherwise generate sparks.

Each of the PTC heating elements 16 is packaged in an electrically isolating jacket 17 formed of a material having a high coefficient of thermal conductivity. The jacket 17 is shown in FIG. 4A partially removed to reveal the conductive plates 16*a* and 16*b* of the PTC heating element 16. Thus, when the PTC heating elements 16 are tightly sandwiched between the conductive metal heat exchanger blocks, to promote good thermal conductivity therewith, the jacket 17 prevents the conductive plates 16*a* and 16*b* of the heating element from making electrical contact with the heat exchanger blocks while at the same time permitting the efficient transfer of the heat generated by the heating element through the jacket to the heat exchanger blocks. The electrically isolating, heat conductive jacket 17 of the PTC heating elements 16 used is made of KAPTON®, a polyamide film presently available from du Pont de Nemours and Company of Wilmington Del. The PTC heating element is shown fully inside its jacket 17 in FIG. 4B.

Figure 5:
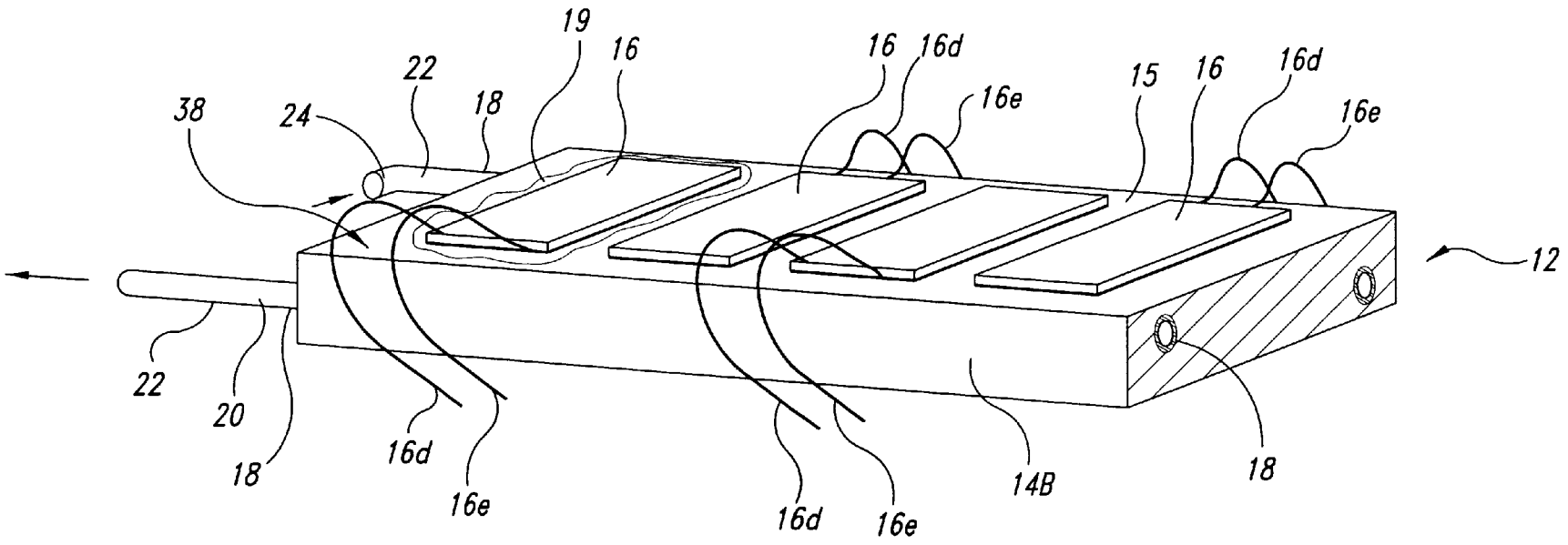
FIG. 5 is a fragmentary isometric view of one of the heat exchanger blocks showing placement of four of the heating elements of the vaporizer of FIG. 1.

To facilitate good thermal transfer from the PTC heating elements 16 to the heat exchanger blocks 14A and 14B, each of the heat exchanger blocks has a face 15 which is machined flat and the heat exchanger 12 is assembled with the flat faces 15 of the two heat exchanger blocks facing toward each other with the PTC heating elements 16 oriented with one of the conductive plates 16*a* and 16*b* toward the flat face of one of the heat exchanger blocks and the other of the conductive plates toward the flat face of the other heat exchanger blocks. Thus, the heat exchanger blocks 14A and 14B when bolted together using the bolts 26, are separated by only the thickness of one of the PTC heating elements 16 to provide a low side profile to the heat exchanger 12 and a compact design. The flat faces 15 also provide good surface contact with nearly the entire flat exterior surfaces of both faces of the PTC heating elements 16 to facilitate maximum heat transfer to the heat exchanger blocks 14A and 14B. To further facilitate good heat transfer, a heat transfer grease 19 or other medium is applied so it is positioned between the faces of the PTC heating element and the flat face 15 of each of the heat exchanger blocks 14A and 14B, as shown for one heat exchanger block 14B in FIG. 5. While not illustrated in the drawings, to better distribute the heat generated by the heating elements 16, every other heating element is shifted toward one or the other longitudinal edges of the heat exchanger blocks 14A and 14B, such that adjacent heating elements are longitudinally offset from each other.

While the vaporizer 10 shown and described has included two heat exchanger blocks 14A and 14B, it is to be understood that a vaporizer according to the present invention can be constructed using more that two heat exchanger blocks stacked atop each other with PTC heating elements 16 therebetween. As such, a vaporizer can be constructed using a modular approach by stacking together the necessary number of heat exchanger blocks with PTC heating elements therbetween to provide the vaporizer with the desired operating characteristics. Alternatively, a vaporizer can be constructed using only a single heat exchanger block with the PTC heating elements 16 mounted thereon. The vaporizer 10 and alternative constructions using the present invention have a very low profile and compact size, and can be inexpensively manufactured using off the shelf PTC heating elements 16 and other components.

The construction of the vaporizer 10 lends itself to mass manufacture and eliminates much of the expensive control and safety circuitry and other components previously required with vaporizers using electric heating elements. For example, the vaporizer 10 uses no thermostats, control boards, relays or high limit controls. Since the switching elements and circuitry used in conventional electric heater vaporizers have been eliminated, the vaporizer 10 is safer, more reliable and requires less maintenance. The construction of the heat exchanger blocks 14 using a casting with the vaporizer tube 18 formed integrally therein is inherently economical and maintenance free. Further, the vaporizer 10 has a potentially wider applicability since it is simpler and easier to use. It requires few, if any, adjustments or attention by the user so it can be safely used in applications even where a knowledgeable operator is not present.

The shape of the vaporizer tube 18 used in each of the heat exchanger blocks 14 is best seen in FIGS. 3 and 6. The vaporizer tube 18 extends within the heat exchanger block 14 in which embedded with a first portion extending from the end at which its inlet 20 is located with a generally serpentine pattern toward the opposite end of the heat exchanger block, and then turns back on itself with a second portion extending above the first portion with a generally serpentine pattern back towards the same end. The vaporizer 18 has its inlet 20 and outlet 22 at the same end of the heat exchanger block. This arrangement facilitates use of the coupler tube 24 to connect the outlet 22 of the vaporizer tube 18 of one heat exchanger block with the inlet 20 of the vaporizer tube of another heat exchanger block stacked on the first when connecting a plurality of heat exchanger blocks together in series.

Figure 2:
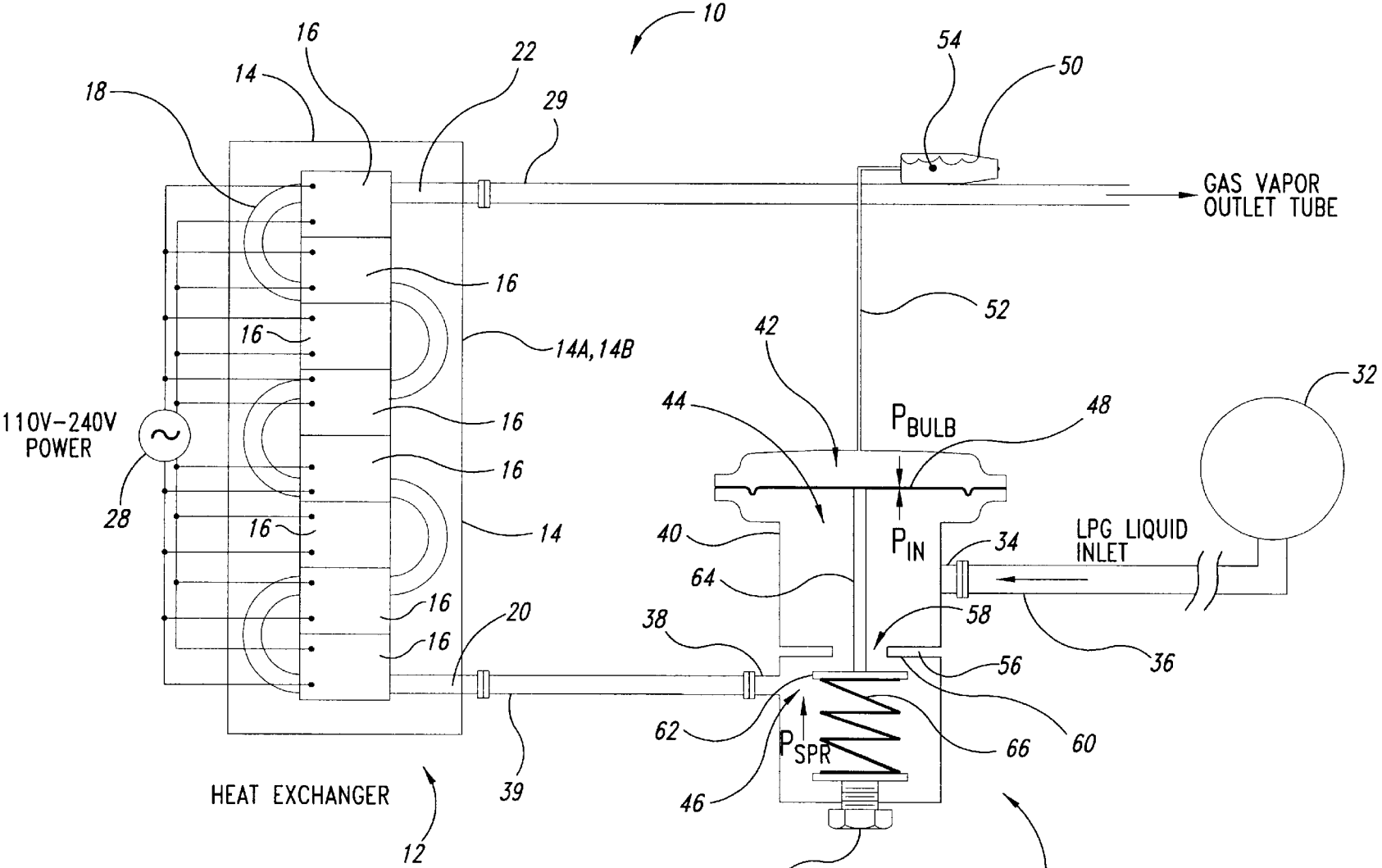
FIG. 2 is a schematic view of the vaporizer of FIG. 1 showing the capacity control valve used to control the inflow of liquefied gas to the heat exchanger in greater detail.

The operation of the vaporizer 10 will now be described. As best shown in FIG. 2, the capacity control valve 30 includes a value inlet 34 connected to a liquefied gas inlet tube 36, which is coupled to and receives liquefied gas from the liquefied gas source 32. The capacity control valve 30 further includes a valve outlet 38 connected to a liquefied gas inlet tube 39, which extends to the inlet 20 of the first heat exchanger block 14A. The capacity control valve 30 is constructed generally the same as a thermal expansion valve (TEX), such as commonly used in air conditioning systems. However, the capacity control valve 30 is operated in reverse of the operation of a thermal expansion valve in an air conditioning system to perform a different function, as will be describe below.

The capacity control valve 30 includes a valve body 40 having a thermal expansion chamber 42, a liquefied gas inlet chamber 44 and a liquefied gas outlet chamber 46. A diaphragm 48 divides the thermal expansion chamber 42 from the liquefied gas inlet chamber 44. In the illustrated embodiment, the diaphragm is a flexible, thin metal disk of conventional design. A thermal sensing bulb 50 is positioned in thermal contact with the gas vapor outlet tube 29 connected to the outlet 22 of the second heat exchanger block 14B, which carries the vaporized gas from the heat exchanger 12, at a location reasonably close to the heat exchanger outlet 22. The thermal sensing bulb 50 is connected by a tube 52 to the thermal expansion chamber 42. When the vaporizer 10 is implemented for use with liquefied petroleum gas as being described herein, the sensing bulb 50 is charged with an expansion fluid 54 having saturation properties similar to those of liquefied petroleum gas. The tube 52 provides fluid communication of the fluid 54 between the sensing bulb 50 and the thermal expansion chamber 42.

The diaphragm 48 is configured to respond to a pressure differential between the thermal expansion chamber 42 and the liquefied gas inlet chamber 44. At equilibrium, when the pressure in both chambers 42 and 44 is equal, the diaphragm 48 is balanced in an "at rest" position between the chambers 42 and 44. A pressure difference between the thermal expansion chamber 42 and the liquefied gas inlet chamber 44 causes the diaphragm 48 to move or flex into the one of the chambers 42 and 44 having the lesser pressure therein. The degree of expansion, i.e., the distance that the diaphragm 48 moves into the lower pressure chamber, is a function of the difference in pressure between the chambers 42 and 44: the greater the pressure differential, the farther the diaphragm 48 moves. Thus, the diaphragm 48 moves along a continuum that is infinitely variable in response to changes in the pressure differential between the thermal expansion chamber 42 and the liquefied gas inlet chamber 44.

The valve inlet 34 of the capacity control valve 30 supplies the liquefied gas carried by the liquefied gas inlet tube 36 to the liquefied gas inlet chamber 44. The valve outlet 38 discharges the liquefied gas in the liquefied gas outlet chamber 46 to the liquefied gas inlet tube 39 to supply the liquefied gas to the inlet 20 of the first heat exchanger block 14A for vaporization by the heat exchanger 12. An annular wall 56 with a central orifice 58 divides the liquefied gas inlet chamber 44 from the liquefied gas outlet chamber 46. A valve seat 60 is formed on an underside of the annular wall 56, about the orifice 58, and a valve 62 is positioned below the annular wall and is operatively movable between a fully closed position with the valve seating in the valve seat, and a fully open position with the valve moved downward, substantially away from the valve seat. The valve 62 is positionable at all positions between the fully closed and fully open positions, as will be described in greater detail below.

When the valve 62 is in the fully closed position, in seated arrangement with the valve seat 60, the valve blocks the flow of liquefied gas from the liquefied gas inlet chamber 44 into the liquefied gas outlet chamber 46, and hence blocks the flow of liquefied gas to the heat exchanger 12. As the valve 62 opens and moves downward progressively farther away from the valve seat 60, the flow of liquefied gas from the liquefied gas inlet chamber 44 into the liquefied gas outlet chamber 46 progressively increases, as does the flow of liquefied gas to the heat exchanger 12. As the open valve 62 moves upward progressively closer to the valve seat 60, the flow of liquefied gas from the liquefied gas inlet chamber 44 into the liquefied gas outlet chamber 46 progressively decreases, as does the flow of liquefied gas to the heat exchanger 12.

The movement of the valve 62 is principally controlled by the movement of the diaphragm 48 using a rigid valve stem 64, which couples the valve 62 to the diaphragm 48 for movement therewith. An upper end of the valve stem 64 is attached to a central portion of the diaphragm 48, and a lower end of the valve stem is attached to a central portion the valve 62. When a pressure differential exists between the thermal expansion chamber 42 and the liquefied gas inlet chamber 44, the diaphragm 48 moves toward the chamber with the lesser pressure therein, and the valve stem 64 causes the valve 62 to move in the same direction and by the same amount relative to the valve seat 60.

In operation, the movements of the diaphragm 48 open and close the valve 62 as the relative pressures of the liquefied gas in the liquefied gas inlet chamber 44 and the liquid 54 in the thermal expansion chamber 42 change. If the pressure $P_{BULB}$ of the liquid 54 in the thermal expansion chamber 42 should decrease, as a result of the sensing bulb 50 sensing the temperature of the gas vapor in the gas vapor outlet tube 20 decreasing, the diaphragm 48 will move upward into the thermal expansion chamber 42 and the valve stem 64 will drive the valve 62 upward. With sufficient upward movement the valve 62 will reach the fully closed position, with the valve seated in the valve seat 60 and the flow of liquefied gas to the heat exchanger 12 completely blocked. Of course, the direction and amount of movement of the valve 62 results from the amount and direction of the differential pressure experienced by the diaphragm 48. If the pressure $P_{IN}$ of the liquefied gas in the liquefied gas inlet chamber 44 should also increase or decrease, the valve 62 will move upward in a different amount, and could even move in the downward direction.

If the pressure $P_{BULB}$ of the liquid 54 in the thermal expansion chamber 42 should increase, as a result of the sensing bulb 50 sensing the temperature of the gas vapor in the gas vapor outlet tube 29 increasing, the diaphragm 48 will move downward into the liquefied gas inlet chamber 44 and the valve stem 64 will drive the valve 62 downward. With sufficient downward movement the valve 62 will reach the fully open position, with the valve spaced far from the valve seat 60 and the flow of liquefied gas to the heat exchanger 12 substantially uninhibited. The more the movement opens the valve 62, the larger the flow of liquefied gas to the heat exchanger. If the pressure $P_{IN}$ of the liquefied gas in the liquefied gas inlet chamber 44 should also increase or decrease, the valve 62 will move downward in a different amount, and could even move in the upward direction. Again, the direction and amount of movement of the valve 62 results from the amount and direction of the differential pressure experienced by the diaphragm 48, the differential pressure being the difference between the pressure of the liquid 54 in the thermal expansion chamber 42 (which is dependent on the temperature of the gas vapor in the gas vapor outlet tube 29 being measured by the sensing bulb 50) and the pressure of the liquefied gas in the liquefied gas inlet chamber 44 (which is dependent on the pressure of the liquefied gas being supplied to the vaporizer 10 by the liquefied gas source 32).

The pressure of the liquefied gas in the liquefied gas inlet chamber 44 is the inlet pressure of the liquefied gas supplied to the vaporizer 10 by the liquefied gas source 32. This vaporizer inlet pressure changes with the conditions experienced by the liquefied gas source 32, such as the temperature of the source, and the vaporizer inlet pressure tends to follow the saturation pressure of the input gas. Thus, the capacity control valve 30 controls the input flow of liquefied gas to the heat exchanger 12 based upon both the temperature of the gas vapor in the gas vapor outlet tube 29 and the inlet pressure of the liquefied gas supplied to the vaporizer 10 by the liquefied gas source 32, unlike some prior art vaporizers which only controlled the input flow based upon the temperature of the gas vapor produced without concern for the inlet pressure of the liquefied gas being supplied to the vaporizer. As such, these prior art vaporizers do not adequately respond to the changing conditions of the liquefied gas input to the vaporizer.

As noted above, the amount and direction of the movement of the diaphragm 48, and hence the amount and direction of movement of the valve 62 and the amount of liquefied gas that the valve allows to flow through the capacity control valve 30 into the inlet tube 39 of the heat exchanger 12, are a function of the pressure differential between the thermal expansion chamber 42 and the liquefied gas inlet chamber 44. Accordingly, a pressure within the liquefied gas inlet chamber 44 that is greater than the pressure in the thermal expansion chamber 42 will cause the diaphragm 48 to move upward and the valve stem 64 to move the valve 62 toward the valve seat 60 and the fully closed position, thereby progressively reducing the flow of liquefied gas to the heat exchanger 12. Conversely, a pressure within the thermal expansion chamber 42 that is greater than the pressure of the liquefied gas inlet chamber 44 will cause the diaphragm 48 to move downward and the valve stem 64 to move the valve 62 away from the valve seat 60 and toward the fully open position, thereby progressively increasing the flow of liquefied gas to the heat exchanger 12. Preferably, the valve 62, the valve seat 60, and the valve stem 64 are configured in combination with the diaphragm 48 such that when at equilibrium, with the pressure across the diaphragm balanced and the diaphragm 48 in the "at rest" position, the valve 62 is at a distance away from the valve seat 60 such that the pressurized flow of liquefied gas passing through the capacity control valve 30 and into the heat exchanger 12 is at a predetermined flow rate selected to provide the desired rated output of gas vapor in the outlet tube 29 at a desired superheated temperature under normal operation of the vaporizer 10.

As discussed, the pressure differential across the diaphragm 48 is the difference between the inlet liquefied gas pressure $P_{IN}$ within the liquefied gas inlet chamber 44 and the pressure $P_{BULB}$ of the liquid 54 in the thermal expansion chamber 42. Change in the temperature of the gas vapor exiting the heat exchanger 12 through the outlet tube 29 is indicative of a change in the operating condition occurring inside the heat exchanger 12, with the liquid 54 within the sensing bulb 50 communicating that change of gas vapor temperature to the thermal expansion chamber 42. As noted above, the sensing bulb 50 is charged with a fluid having saturation properties similar to those of the liquefied gas for which the vaporizer 10 of the invention is implemented, such as liquid petroleum gas for the embodiment described herein. Similarly, a change in the condition experienced by the liquefied gas source 32 is communicated to the liquefied gas inlet chamber 44 via the valve inlet 34. In operation, the net result of these changes is movement of the diaphragm 48 and hence adjustment by the capacity control valve 30 of the liquefied gas supplied to the heat exchanger 12.

For example, assuming that the diaphragm 48 was in the "at rest" position and the valve 62 was in a correspondingly open position, if a condition occurs such that the temperature of the vaporized gas in the outlet tube 29 goes down, the liquid 54 in the sensing bulb 50 contracts and the pressure in the thermal expansion chamber 42 decreases. This might result because the heat exchanger 12 is receiving a larger flow of liquefied gas than the heating elements 16 can vaporize with the desired gas vapor temperature. Assuming that there is no change also occurring in the condition of the liquefied gas source 32, this will cause the valve 62 to move upward and reduce the flow of liquefied gas to the heat exchanger 12. As the flow of liquefied gas to the heat exchanger 12 decreases, the heat produced by the heating elements 16 will be transferred to the now smaller flow of liquefied gas into the vaporization tube 18. As a result, the temperature of the vaporized gas exiting the outlet 22 of the second heat exchanger block 14B will begin to increase compared to the temperature of the vaporized gas the electric heater had been producing at the higher flow rate. As the temperature of the gas vapor in the outlet tube 29 sensed by the sensing bulb 50 rises, the liquid 54 will begin to expand and the pressure in the thermal expansion chamber 42 will increase. This will cause the valve 62 to move downward and further open the valve 62 to increase the flow of liquefied gas to the heat exchanger 12 until the flow rate through the vaporization tube 18 allows the heating elements 16 to produce gas vapor in the outlet 22 of the second heat exchanger 14B at the desired temperature.

This operation also insures that only gas vapor, and not liquefied gas flows out the outlet 22 of the second heat exchanger block 14B since should the heat exchanger 12 start flooding with liquefied gas, the gas vapor being produced will become very saturated and its temperature will drop, thus moving the valve 62 toward the fully closed position and restricting or even cutting off the flow to and from the heat exchanger 12 until the temperature of the gas vapor in the outlet tube 29 rises to the desired temperature. However, since the diaphragm 48 is responsive to the pressure $P_{IN}$ of the liquefied gas in the liquefied gas inlet chamber 44 (i.e., the inlet pressure of the liquefied gas supplied to the vaporizer 10 by the liquefied gas source 32), and not just the temperature of the gas vapor in the outlet tube 29, should a change in the inlet pressure be occurring at the same time, the operation of the capacity control valve 30 takes that into account. For example, if the inlet pressure is rising, the valve 30 will be closed even further, but if the inlet pressure is falling, the valve will not be closed as far, thereby producing overall better results than if only the temperature of the gas vapor in the outlet tube 29 was used to control the operation of the capacity control valve. Thus, the flow of liquefied gas into the heat exchanger 12 will be more accurately controlled to provide gas vapor at the desired temperature and the flow of liquefied gas into the heat exchanger 12 will not exceed the vaporization ability of the heating elements 16.

In contrast to the flooding condition just discussed, should gas vapor in the outlet tube 29 increase in the temperature beyond the desired superheated temperature, the liquid 54 in the sensing bulb 50 will expand and the pressure in the thermal expansion chamber 42 increase. This might result because the heat exchanger 12 is receiving a smaller flow of liquefied gas than the heating elements 16 can vaporize with the desired gas vapor temperature, thus overheating the gas that is vaporized. Assuming that there is no change also occurring in the condition of the liquefied gas source 32, this will cause the valve 62 to move downward and increase the flow of liquefied gas to the heat exchanger 12. As the flow of liquefied gas to the heat exchanger 12 increases, the heat produced by the heating elements 16 will be transferred to the now larger flow of liquefied gas into the vaporization tube 18. As a result, the temperature of the vaporized gas exiting the outlet 22 of the second heat exchanger block 14B will begin to decrease compared to the excessive temperature of the vaporized gas the heating elements had been producing at the lower flow rate. As the temperature of the gas vapor in the outlet tube 29 sensed by the sensing bulb 50 lowers, the liquid 54 will begin to contract and the pressure in the thermal expansion chamber 42 will decrease. This will cause the valve 62 to move upward and further close the valve 62 to decrease the flow of liquefied gas to the heat exchanger 12 until the flow rate through the vaporization tube 22 allows the electric heater 12 to produce gas vapor in the outlet tube 20 at the desired temperature. As a result, the vaporizer 10 is self-regulating to always produce gas vapor at its maximum design capacity and at the desired temperature.

Again, since the diaphragm 48 is responsive to the pressure $P_{IN}$ of the liquefied gas in the liquefied gas inlet chamber 44 (i.e., the inlet pressure of the liquefied gas supplied to the vaporizer 10 by the liquefied gas source 32), and not just the temperature of the gas vapor in the outlet tube 29, should a change in the inlet pressure be occurring at the same time, the operation of the capacity control valve 30 takes that into account. For example, if the inlet pressure is falling, the valve 62 will be opened even further, but if the inlet pressure is rising, the valve will not be opened as far, thereby producing overall better results than if only the temperature of the gas vapor in the outlet tube 29 was used to control the operation of the capacity control valve. Thus, the flow of liquefied gas into the heat exchanger 12 will be more accurately controlled to provide gas vapor at the desired temperature.

The capacity control valve 30 includes a biasing spring 66 positioned between the valve 62 and an adjustment screw 68, to apply an upward biasing force or spring pressure $P_{SPR}$ on the valve tending to urge the valve toward the fully closed position. The biasing spring 66 is arranged directly below the valve 62, in coaxial alignment with the valve stem 64, and provides a resistance force against downward movement of the valve which must be overcome by the pressure $P_{BULB}$ of the liquid 54 in the thermal expansion chamber 42, in addition to the pressure $P_{IN}$ within the liquefied gas inlet chamber 44, to move the valve downward toward the fully open position. If the pressure $P_{BULB}$ of the liquid 54 in the thermal expansion chamber 42 minus the sum of the pressure $P_{IN}$ within the liquefied gas inlet chamber 44 and the spring pressure $P_{SPR}$ is greater than zero, then the valve 62 will open (i.e., if: $P_{BULB}-[P_{IN}+P_{SPR}]>0$, then the valve will open).

The adjustment screw 68 is located to engage and selectively adjustably move upward or downward the lower end of the biasing spring 66. This is accomplished by rotating the adjustment screw to threadably move it inward or outward to increase or decrease, respectively, the amount of upward force the biasing spring 66 applies to the valve, which sets the "at rest" position of the diaphragm 48, i.e., the position the diaphragm will assume if the pressure in both the chambers 42 and 44 is equal. The effect is to set the superheated temperature to which the heat exchanger 12 will heat the gas vapor in the outlet tube 29 under normal operation of the vaporizer 10. The capacity control valve 30 thus prevents liquefied gas (in the illustrated embodiment LPG liquid) carryover into outlet tube 29 by ensuring a minimum amount of superheat within the heat exchanger 12.

Figure 7:
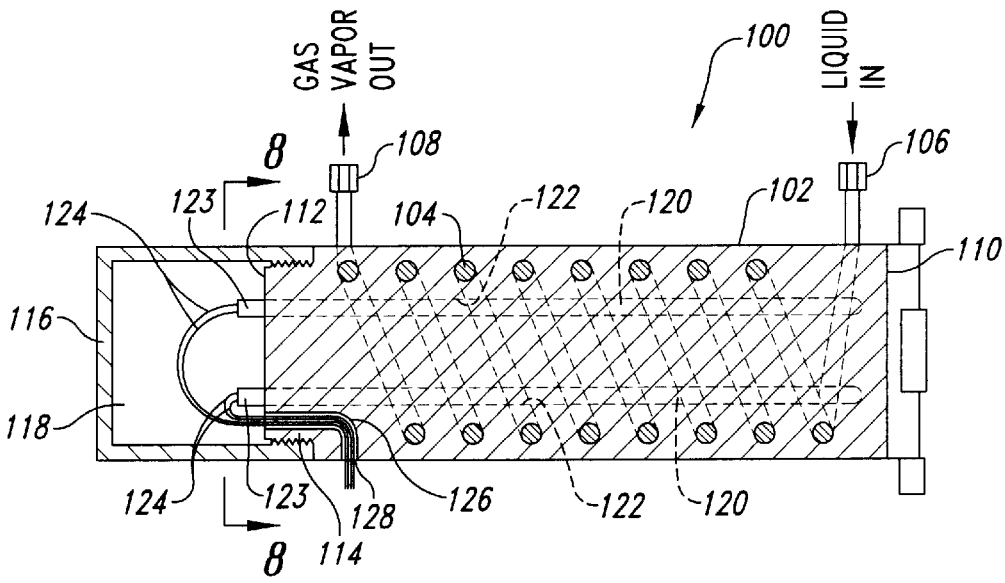
FIG. 7 is a cross-sectional side view of a second embodiment of a heat exchanger of a liquefied gas vaporizer embodying the present invention.
Figure 8:
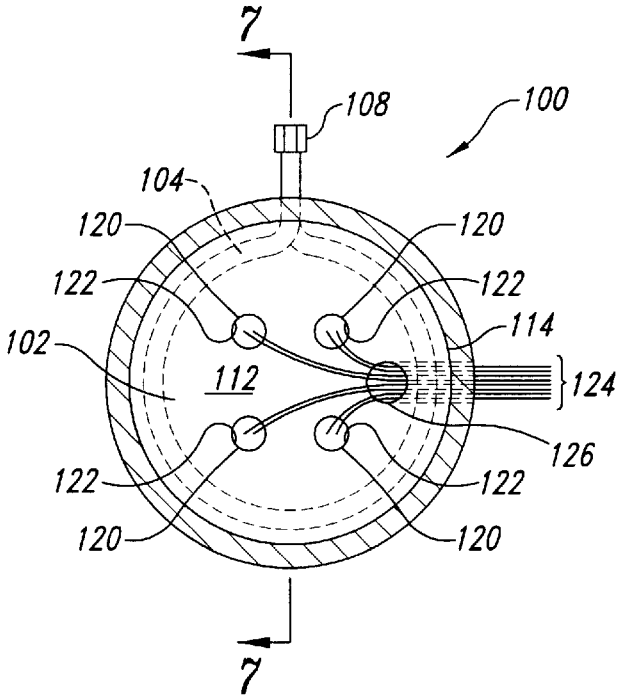
FIG. 8 is a cross-sectional end view taken substantially along line 8—8 of FIG. 7.

A second embodiment of a heat exchanger 100 according to the present invention is shown in FIGS. 7 and 8. In this embodiment, the heat exchanger 100 includes a solid cylindrical body 102 of cast aluminum or another suitable rigid material with a coiled vaporization tube 104 encased therein. The coil of the vaporization tube 104 is wound about a longitudinal axis of the cylindrical body 102. The vaporization tube 104 has an inlet 106 to receive the liquefied gas from a liquefied gas source 32 (see FIG. 1), such as a liquefied petroleum gas storage tank, using a capacity control valve 30 (see FIG. 1) or otherwise. The vaporization tube 104 also has an outlet 108 from which the gas vapor exits the heat exchanger 100. The inlet 106 and the outlet 108 project from a sidewall of the cylindrical body 102. The inlet 106 is located toward a first end 110 of the cylindrical body 102 and the outlet 108 is located toward a second end 112 of the cylindrical body. The second end 112 of the cylindrical body 102 has a threaded end portion 114 to removably receive a threaded end cap 116, which when threaded onto the threaded end portion of the cylindrical body defines an chamber 118 within the end cap.

In this second embodiment, the heat exchanger 100 includes four rod shaped heating elements 120 made of a positive temperature coefficient (PTC) material. Each of the heating elements 120 is positioned in one of four elongated, round apertures 122 in the cylindrical body 102 extending fully through the second end 112 of the cylindrical body and in communication with the chamber 118, and toward the first end 110 of the cylindrical body but not extending outward of the cylindrical body at the first end. The apertures 122 can be made as part of the casting process, drilled, reamed or in another suitable manner. When in position in the aperture 122, an end portion 123 of the heating element 120 projects out of the aperture and into the chamber 118. A pair of electrical leads 124 is attached to the end portion 123 of each heating element 120 for supplying electrical power to the heating element. The electrical leads 124 extend into the chamber 118 and exit the chamber through a wire conduit 126 formed in the cylindrical body 102 which extends between the second end 112 of the cylindrical body, at a position within the chamber and covered by the end cap 116, and a port 128 in the sidewall of the cylindrical body at a location toward the second end. The end cap 116 serves to protect both the heating elements 120 and the electrical leads 124 from damage.

Figure 9:
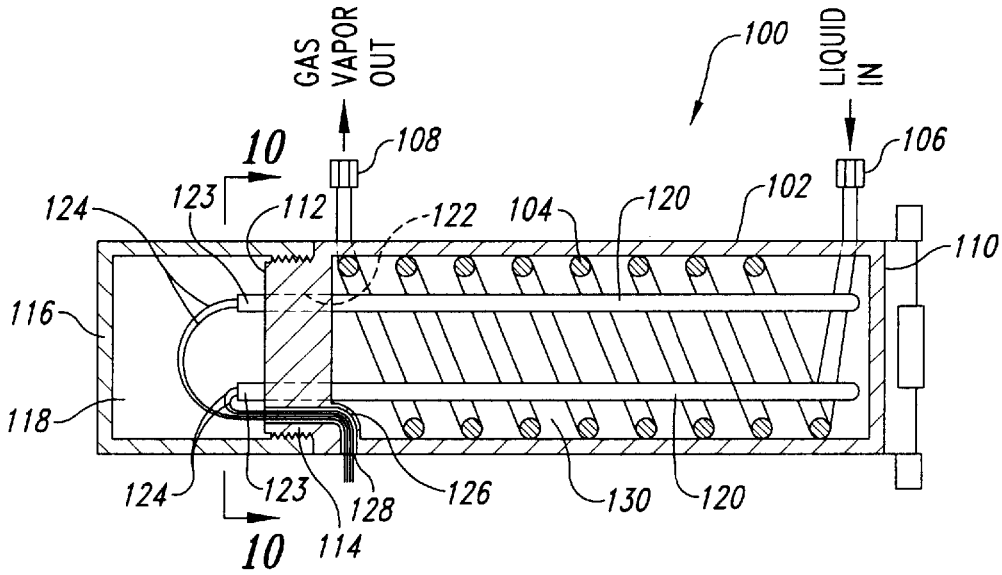
FIG. 9 is a cross-sectional side view of a third embodiment of a heat exchanger of a liquefied gas vaporizer embodying the present invention.
Figure 10:
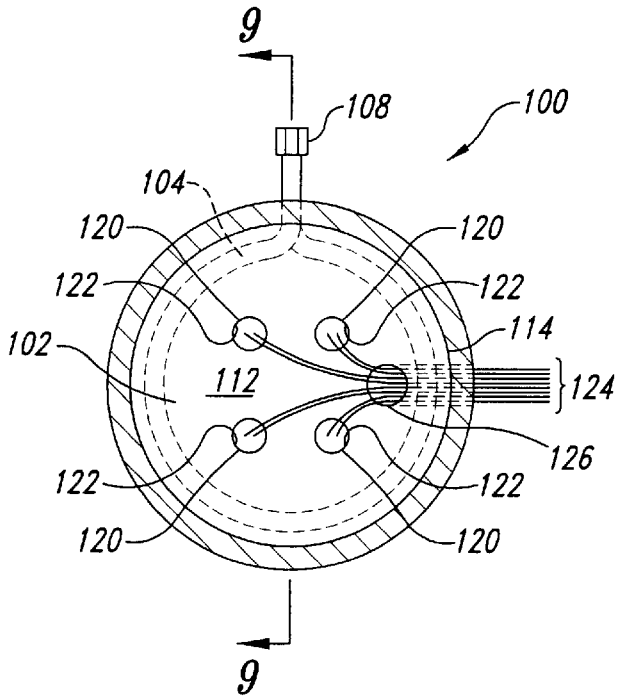
FIG. 10 is a cross-sectional end view taken substantially along line 10—10 of FIG. 9.

In yet a third embodiment shown in FIGS. 9 and 10, very similar to that of FIGS. 7 and 8, the cylindrical body 102 has a body chamber 130 filled with water or another suitable heat transfer media. The heating elements 120 extend into the body chamber 130 and are in thermal contact with the heat transfer media therein.

The heating elements 120 used in the second and third embodiments, and the design of the heat exchanger 100 generally, provide the self-regulating heat and other benefits discussed above for the first described embodiment.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A vaporizer for vaporizing a fluid, comprising:

a heat exchanger having a block of thermally conductive material with a thermally conductive tube embedded therein to transfer heat from the thermally conductive material of the block to the contents of the tube, the block having a substantially planar surface portion, the tube having an inlet portion to receive the fluid to be vaporized and an outlet portion to discharge the vaporized fluid, the inlet and outlet portions projecting from the block; and a plurality of positive temperature coefficient heater elements, each heater element including first and second conductive plates and a plurality of positive temperature coefficient heating stones in electrical contact with, and sandwiched between the conductive plates in an electrically parallel configuration and having a substantially planar surface, the heater elements positioned with their planar surfaces in face-to-face surface contact with the planar surface portion of the block.

2. The vaporizer of claim 1, wherein The heater elements are arranged in a single row alignment, with every other one of the heater elements in the row longitudinally offset from the adjacent heater elements.

3. The vaporizer of claim 1, wherein the heater elements are electrically coupled in parallel.

4. The vaporizer of claim 1, wherein the tube extends within the block along a curved path, the curved path lying in a plane parallel to the plane of the planar surface portion of the block.

5. The vaporizer of claim 4, wherein the block further includes first and second opposed end surfaces, the inlet and outlet portions of the tube projecting from the first end surface of the block, the curved path of the tube extending from the inlet portion at the first end surface to a second end position adjacent to the second end surface, and from the second end position to the outlet portion at the first end surface.

6. The vaporizer of claim 1, wherein the block further includes first and second opposed end surfaces, the inlet and outlet portions of the tube projecting from the first end surface of the block and wherein the tube extends between the inlet portion at the first end surface and a second end position adjacent to the second end surface along a first curved path in a first plane parallel to the plane of the planar surface portion of the block and extends between the second end position and the outlet portion at the first end surface along a second curved path in a second plane parallel to the plane of the planar surface portion of the block, the first and second planes being off-set relative to each other within the block.

7. The vaporizer of claim 6, wherein one of the first and second curved paths is located within the block toward the planar surface portion of the block.

8. The vaporizer of claim 6, wherein one of the first and second curved paths is located within the block toward the planar surface portion of the block.

9. The vaporizer of claim 1 wherein the heater elements each have a cure temperature greater than the saturation temperature of the fluid to be vaporized.

10. The vaporizer of claim 9, wherein the fluid to be vaporized is a liquefied hydrocarbon gas.

11. The vaporizer of claim 1 for use with an electrical power source, wherein the heater elements are connectable directly to the power source without regulation by the vaporizer of the power supplied by the power source.

12. A vaporizer for vaporizing a fluid, comprising:

a heat exchanger having a first block of thermally conductive material with a thermally conductive first tube embedded therein to transfer heat from the thermally conductive material of the first block to the contents of the first tube, the first block having a substantially planar surface portion, the first tube having an inlet portion to receive the fluid to be vaporized and an outlet portion to discharge the vaporized fluid, the first tube extending within the first block along a first curved path lying in a first plane parallel to the plane of the planar surface portion of the first block, the inlet and outlet portions projecting from the first block, and having a second block of thermally conductive material with a thermally conductive second tube embedded therein to transfer heat from the thermally conductive material of the second block to the contents of the second tube, the second block having a substantially planar surface portion, the second tube having an inlet portion to receive the fluid to be vaporized and an outlet portion to discharge the vaporized fluid, the second tube extending within the second block along a second curved path lying in a second plane parallel to the plane of the planar surface portion of the second block, the inlet and outlet portions projecting from the second block, the first and second blocks being arranged with the planar surface portions of the first and second blocks facing each other and spaced apart from each other to define a space therebetween, the outlet portion of the first tube being connected to the inlet portion of the second tube; and a plurality of positive temperature coefficient heater elements, each formed with first and second opposed substantially planar, parallel surfaces, the heater elements being positioned within the space between the first and second blocks with the first planar surfaces of the heater elements in face-to-face surface contact with the planar surface portion of the first block and with the second planar surfaces of the heater elements in face-to-face surface contact with the planar surface portion of the second block.

13. The vaporizer of claim 12, wherein the heater elements are arranged in a single row alignment and wherein the heater elements are elongated and each oriented with a longitudinal axis arranged transverse to a direction of the row.

14. The vaporizer of claim 13, wherein every other one of the heater elements in the row is longitudinally offset from the adjacent heater elements.

15. The vaporizer of claim 12, wherein the first and second blocks each further includes first and second opposed end surfaces, the inlet and outlet portions of the first and second tubes projecting from the first end surface of the first and second blocks, respectively, the first and second curved paths of the first and second tubes each extending from the inlet portion at the first end surface to a second end position adjacent to the second end surface, and from the second end position to the outlet portion at the first end surface.

16. The vaporizer of claim 15, wherein the first tube extends in the first block between the inlet portion at the first end surface and the second end position along the first curved path and extends between the second end position and the outlet portion at the first end surface along a third curved path in a third plane, parallel to the plane of the planar surface portion of the first block, and offset from the first plane; and wherein the second tube extends in the second block between the inlet portion at the first end surface and the second end position along the second curved path and extends between the second end position and the outlet portion at the first end surface along a fourth curved path in a fourth plane, parallel to the plane of the planar surface portion of the second block, and offset from the second plane.

17. The vaporizer of claim 16, wherein one of the first and third curved paths and one of the second and fourth curved paths is located within the respective first block toward the planar surface portion thereof.

18. The vaporizer of claim 12 wherein the heater elements each have a cure temperature greater than the saturation temperature of the fluid to be vaporized.

19. The vaporizer of claim 18 wherein the fluid to be vaporized is a liquefied hydrocarbon gas.

20. The vaporizer of claim 12 for use with an electrical power source, wherein the heater elements are connectable directly to the power source without regulation by the vaporizer of the power supplied by the power source.

21. A modular vaporizer for vaporizing a fluid, comprising:

(a) a plurality of heat exchangers, each heat exchanger including:

(i) a block of thermally conductive material with at least one surface thereof having at least one substantially planar surface portion, the blocks of the heat exchangers being stackable together with each block adjacent to at least one other block of the heat exchangers with the planar surface portions of the adjacent blocks facing toward each other; and (ii) a thermally conductive tube embedded within the block to transfer heat from the thermally conductive material of the block to the contents of the tube, the tube extending in a serpentine path lying in a plane parallel to the plane of the planar surface portion, the tube having an inlet portion to receive the fluid to be vaporized and an outlet portion to discharge the vaporized fluid, the outlet portion of the tube of one block of adjacent blocks being connected to the inlet portion of the tube of the other block of the adjacent blocks;

(b) positive temperature coefficient heater elements each having first and second opposed substantially planar and parallel surfaces, a plurality of the heater elements being positioned between the adjacent blocks with the first planar surfaces of the heater elements in face-to-face surface contact with the planar surface portion of one block of adjacent blocks and with the second planar surfaces of the heater elements in face-to-face surface contact with the planar surface portion of the other block of the adjacent blocks; and (c) at least one member holding the blocks of adjacent blocks tightly together with the heater elements positioned therebetween clamped tightly between the planar surface portions of the adjacent blocks.

22. The vaporizer of claim 21, wherein the inlet and outlet portions of the first and second tubes of each block project from the block.

23. The vaporizer of claim 21, wherein the heater elements are arranged in a single row alignment between the adjacent blocks.

24. The vaporizer of claim 21, wherein the blocks each further includes an end surface with the inlet and outlet portions of the tube of the block project from the end surface of the block, the end surfaces of the adjacent blocks being arranged next to each other to position the outlet portion of the tube of one block of adjacent blocks near the inlet portion of the tube of the adjacent block.

25. The vaporizer of claim 21, wherein the heater elements are electrically coupled in parallel.

26. The vaporizer of claim 21 wherein the heater elements each have a cure temperature greater than the saturation temperature of the fluid to be vaporized.

27. The vaporizer of claim 21 for use with an electrical power source, wherein the heater elements are connectable directly to the power source without regulation by the vaporizer of the power supplied by the power source.

28. A method for forming a low-profile vaporizer, the method comprising:

forming first and second tubes, each with a desired shape and with an inlet portion to receive the fluid to be vaporized and an outlet portion to discharge the vaporized fluid;

encasing each of the first and second tubes in a respective one of first and second blocks of thermally conductive material for the transfer of heat from the thermally conductive material to the contents of the tube, and providing each of the first and second blocks with a surface portion, the encasing step being performed by casting the thermally conductive material around the first and second tubes to form the blocks;

arranging the first and second blocks adjacent to each other with the surface portions thereof facing each other;

arranging a plurality of positive temperature coefficient (PTC) heater elements between the first and second blocks, each PTC heater element including first and second conductive plates and a plurality of positive temperature coefficient heating stones in electrical contact with, and sandwiched between the conductive plates in an electrically parallel configuration, each PTC heater element in thermal contact with the surface portions of the first and second blocks; and coupling the outlet portion of the first tube to the inlet of the second tube.

29. The method of claim 28, further comprising holding the first and second blocks tightly together with the heater elements positioned therebetween clamped tightly between the surface portions of the first and second blocks.

30. The method of claim 28, further comprising arranging the heater elements in a single row alignment between the first and second blocks.

31. The method of claim 28, further comprising electrically connecting the heater elements in parallel.

32. The method of claim 28, further comprising selecting the heater elements with a cure temperature greater than the saturation temperature of the fluid to be vaporized.

33. The method of claim 28, further comprising providing the surface portions of the second block with a planar surface, arranging the first and second blocks adjacent to each other with the planar surfaces thereof in substantially parallel arrangement, selecting the heater elements to each have first and second opposed substantially planar, parallel surfaces, and positioning the heater elements between the first and second blocks with the first planar surfaces of the heater elements in face-to-face surface contact with the planar surface of the first block and with the second planar surfaces of the heater elements in face-to-face surface contact with the planar surface of the second block.

34. A method, comprising:

introducing a fluid into a first end of a tube encased in a block of thermally conductive material having a first planar surface; and applying a voltage to a plurality of positive temperature coefficient (PTC) heating elements, each PTC element including first and second conductive plates and a plurality of positive temperature coefficient heating stones in electrical contact with, and sandwiched between the conductive plates in an electrically parallel configuration and having a second planar surface in contact with the first planar surface, thereby heating the element, the thermally conductive material in contact therewith, and the tube, to a temperature exceeding the saturation temperature of the fluid, and vaporizing the fluid in the tube.

35. The method of claim 34 wherein the fluid is a hydrocarbon.

36. The method of claim 34 wherein the fluid is a liquefied gas.

37. The method of claim 34, further comprising:

extracting the vaporized fluid from a second end of the tube;

introducing additional fluid into the tube during the extracting step at a rate that does not exceed a rate of vaporization of the fluid.

38. A vaporizer for vaporizing a fluid, comprising:

a heat exchanger having a block of thermally conductive material with a thermally conductive tube embedded therein to transfer heat from the thermally conductive material of the block to the contents of the tube, the block having a substantially planar surface portion and first and second opposed end surfaces, the tube having an inlet portion to receive the fluid to be vaporized and an outlet portion to discharge the vaporized fluid, the inlet and outlet portions of the tube projecting from the first end surface of the block and wherein the tube extends between the inlet portion at the first end surface and a second end position adjacent to the second end surface along a first curved path in a first plane parallel to the plane of the planar surface portion of the block and extends between the second end position and the outlet portion at the first end surface along a second curved path in a second plane parallel to the plane of the planar surface portion of the block, the first and second planes being off-set relative to each other within the block; and a plurality of positive temperature coefficient heater elements, each having at least one substantially planar surface, the heater elements being arranged with their planar surfaces in face-to-face surface contact with the planar surface portion of the block.

* * * * *